US007213563B2

(12) United States Patent
Yaguchi et al.

(10) Patent No.: US 7,213,563 B2
(45) Date of Patent: May 8, 2007

(54) PISTON ENGINE HAVING APPROXIMATE STRAIGHT-LINE MECHANISM

(75) Inventors: Hiroshi Yaguchi, Susono (JP); Daisaku Sawada, Gotenba (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 191 days.

(21) Appl. No.: 11/038,538

(22) Filed: Jan. 21, 2005

(65) Prior Publication Data

US 2005/0178353 A1 Aug. 18, 2005

(30) Foreign Application Priority Data

Jan. 22, 2004 (JP) ..... 2004-013851

(51) Int. Cl.
*F02B 75/32* (2006.01)

(52) U.S. Cl. ..... 123/197.3

(58) Field of Classification Search ..... 123/197.1, 123/197.3, 197.4
See application file for complete search history.

(56) References Cited

U.S. PATENT DOCUMENTS 6,227,161 B1 * 5/2001 Urushiyama ..... 123/197.4
6,622,670 B2 * 9/2003 Hiyoshi et al. ..... 123/48 B

FOREIGN PATENT DOCUMENTS

| | | |
|---|---|---|
| JP | A-04-311656 | 11/1992 |
| JP | A 08-093547 | 4/1996 |
| JP | A-09-140018 | 5/1997 |
| JP | A-2000-065265 | 3/2000 |
| JP | A-2001-050362 | 2/2001 |
| JP | A-2003-184214 | 7/2003 |
| WO | WO 2005/033 592 A3 | 4/2005 |

* cited by examiner

*Primary Examiner*—Stephen K. Cronin
*Assistant Examiner*—Hyder Ali
(74) *Attorney, Agent, or Firm*—Oliff & Berridge, PLC

(57) ABSTRACT

An approximate straight-line mechanism that is connected to the connecting portion connecting the piston and the connecting rod regulates the movement of the connecting portion such that it moves in an approximately straight line along the axial center line of the cylinder. In one aspect, the engaging ends of multiple nearly-straight links, as well as the engaging end of the nearly-straight link that engages with the connecting portion connecting the piston and the connecting rod, constitute a single-side-support construction that enables the nearly-straight links to be rotatably connected while engaging from a prescribed direction.

7 Claims, 11 Drawing Sheets

$$\overline{AM} \cdot \overline{QM} = \overline{BM}^2$$

| | | |
|---|---|---|
| STROKE | 36 | [mm] |
| AC: PC RATIO | 3 | [—] |
| AB | 54 | [mm] |
| AM | 22 | [mm] |
| BM | 32 | [mm] |
| QM | 46.55 | [mm] |
| RB | 110 | [mm] |
| $\theta$ | 8.8～−17.9 | [° ] |
| $\phi$ | 0～2.2 | [° ] |

COMPARATIVE EXAMPLE

PISTON ENGINE HAVING APPROXIMATE STRAIGHT-LINE MECHANISM

CROSS-REFERENCE TO RELATED APPLICATIONS

The present application claims the priority based on Japanese Patent Application No. 2004-13851 filed on Jan. 22, 2004, the disclosure of which is hereby incorporated by reference in its entirety.

BACKGROUND OF THE INVENTION

1. Field of the Invention

The present invention relates to a piston-crank mechanism used in a piston engine such as an internal combustion engine or an external combustion engine.

2. Description of the Related Art

In general, friction between the piston and the cylinder comprises at least half of the total friction in a piston engine. Accordingly, there have been various designs in the conventional art that seek to reduce this friction between the piston and the cylinder. For example, in the piston-crank mechanism described in JP2001-50362A, a construction is disclosed wherein the piston and the crank are connected by a free link. This mechanism is constructed so as to ensure that the angle formed by the free link axis relative to the piston central axis at the center of the motion path of the piston is kept as small as possible.

However, because the mechanisms of the conventional art must be increased in size significantly if they are to sufficiently reduce friction, the problem arises that such friction between the piston and the cylinder cannot be reduced sufficiently. Furthermore, an additional problem with the conventional mechanisms is that attaching the mechanism to the piston is a rather complex task.

SUMMARY OF THE INVENTION

An object of the present invention is to provide a mechanism to reduce friction between the piston and the cylinder in which the task of connecting the mechanism to the piston is not unduly complex.

According to an aspect of the present invention, a piston engine comprises a cylinder; a piston configured to move back and forth inside the cylinder; a crankshaft configured to revolve around a drive axis; a connecting rod configured to connect the piston to the crankshaft; and an approximate straight-line mechanism connected to a connecting portion connecting the piston and the connecting rod. The approximate straight-line mechanism regulates movement of the connecting portion such that the connecting portion moves in an approximately straight line along a direction of a central axis of the cylinder. The approximate straight-line mechanism has a plurality of nearly-straight links. Engaging ends of the nearly-straight links, as well as an engaging end of the nearly-straight link that engages with the connecting portion connecting the piston and the connecting rod, constitute a turnable single-side-support construction that enables the nearly-straight links to be turnably connected while engaging from a prescribed direction.

Using this construction, because the two engaging end portions have a single-side-support construction that permits them to be fitted from a single direction during assembly, the mechanism can be assembled easily.

According to another aspect of the present invention, the approximate straight-line mechanism is a grasshopper approximate straight-line mechanism that has first and second lateral links and a vertical link. A first end of the first lateral link has a turnable single-side-support construction such it is turnably connected to the connecting portion connecting the piston and the connecting rod while engaging from a prescribed first direction. A second end of the first lateral link is turnably linked to a first end of the vertical link, a second end of the vertical link is turnably fixed at a prescribed position on the piston engine. A first end of the second lateral link has a single-side-support construction such that it is turnably connected to an engaging portion disposed midway along the first lateral link while engaging from a prescribed second direction. A second end of the second lateral link is turnably fixed at a prescribed position on the piston engine.

Using this construction, because the first ends of the first and second lateral links have a single-side-support construction that allows the first and second lateral links to be attached easily from a single direction during assembly, the mechanism can be assembled easily.

The present invention can be realized in various forms, and may be realized, for example, as a piston-crank mechanism, a piston engine, or a moving body that includes such piston engine.

These and other objects, features, aspects, and advantages of the present invention will become more apparent from the following detailed description of the preferred embodiments with the accompanying drawings.

DESCRIPTION OF THE PREFERRED EMBODIMENT

Embodiments of the present invention will be described below in the following sequence:

A. Basic description of piston-crank mechanism

B. Specific examples

C. Variations

A. Basic Description of Piston-crank Mechanism

Figure 1B:
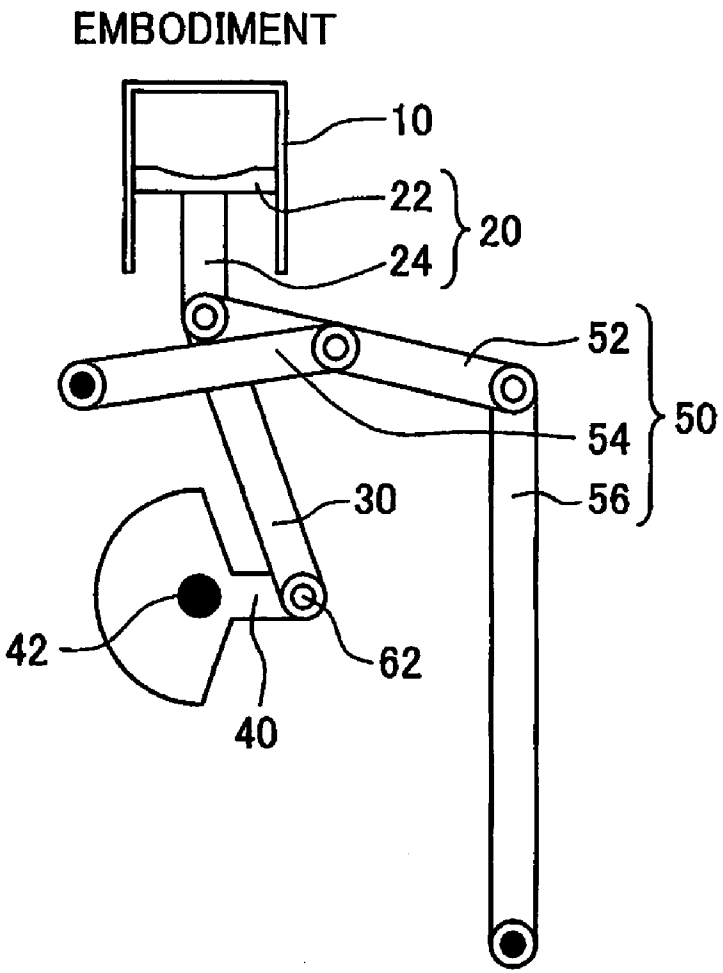
FIGS. 1A and 1B show a comparison between the piston-crank mechanism of the conventional art and a piston-crank mechanism comprising an embodiment of the present invention.
Figure 1A:
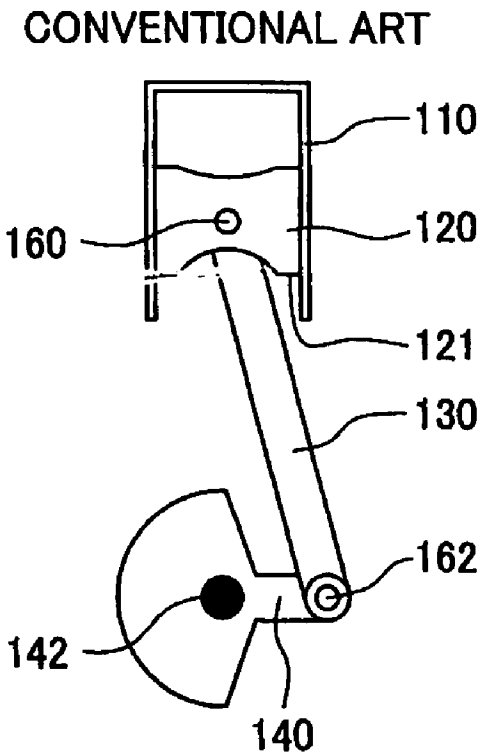

FIGS. 1A and 1B are explanatory drawings showing a comparison of the piston-crank mechanism used in a conventional internal combustion engine with the piston-crank mechanism used in an internal combustion engine comprising an embodiment of the present invention. As shown in FIG. 1A, the conventional mechanism includes a cylinder 110, piston 120, connecting rod 130 and crankshaft 140. The piston 120 and the connecting rod 130 are mutually connected near the center of the piston 120 by a piston pin 160. The connecting rod 130 and the crankshaft 140 are connected by a crank pin 162. When the piston moves vertically back and forth, the crankshaft 140 rotates around its axis 142 (hereinafter also termed the 'drive axis'). A skirt 121 is disposed at the bottom of the piston 120. This skirt 121 receives the horizontal force (thrust) exerted on the piston 120 when fuel combusts in the area of the top dead center of the piston 120.

FIG. 1B shows the basic construction of a piston-crank mechanism comprising an embodiment of the present invention. This mechanism includes a cylinder 10, piston 20, connecting rod 30 and crankshaft 40, as well as an approximate straight-line mechanism 50.

The piston 20 has a roughly plate-like piston head 22 and a piston support rod 24 that extends below the piston head 22. The piston head 22 and piston support rod 24 may be integrally formed. The piston 20 and connecting rod 30 are mutually connected at the bottom end of the piston support rod 24. The connecting rod 30 and crankshaft 40 are mutually connected by a crank pin 62. When the piston 20 moves vertically back and forth, the crankshaft 40 rotates around its axis 42 (also termed the 'drive axis'). As described below, because very little thrust is exerted on this piston 20, the skirt 121 required by the conventional piston 120 is not necessary here.

The approximate straight-line mechanism 50 has two lateral links 52, 54 and a vertical link 56. One end of the first lateral link 52 is turnably connected to the bottom end of the piston support rod 24. One end of the second lateral link 54 is turnably connected to the first lateral link 52 at a prescribed position midway along the first lateral link 52. The other end of the second lateral link 54 is turnably fixed to a prescribed fixed position on the piston-crank mechanism. One end of the vertical link 56 is turnably connected to the first lateral link 52. The other end of the vertical link 56 is turnably fixed to a prescribed fixed position on the piston-crank mechanism.

In FIGS. 1A and 1B, the connecting portion (the drive axis 42 , for example) indicated by black circles (termed 'fulcrum points' below) are linkage points around whose central axis occurs rotation or turn, but whose position relative to the cylinder 10 does not change. The connecting portion indicated by white circles (termed 'moving linkage points' below) are linkage points around whose central axis occurs rotation or turn and whose position relative to the cylinder 10 changes. Here, 'rotate' or 'rotation' indicates motion of at least 360° around the axis, while 'turn' indicates motion of less than 360° around the axis.

The internal combustion engine of this embodiment includes various constituent elements (i.e., valves, intake pipes, exhaust pipes and the like) that are also present in the conventional internal combustion engine, but, with the exception of the piston-crank mechanism and the cylinder 10, such constituent elements are omitted from FIGS. 1A and 1B.

Figure 2A:
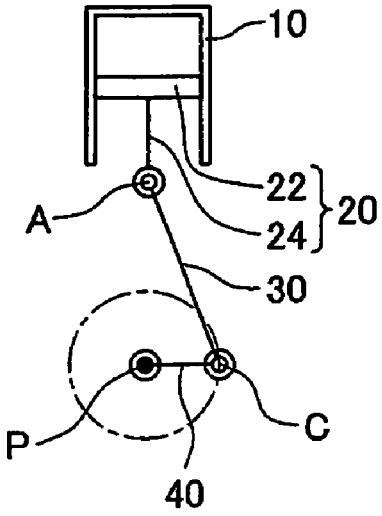
FIGS. 2A–2C illustrate the link construction of a piston-crank mechanism of an embodiment.
Figure 2B:
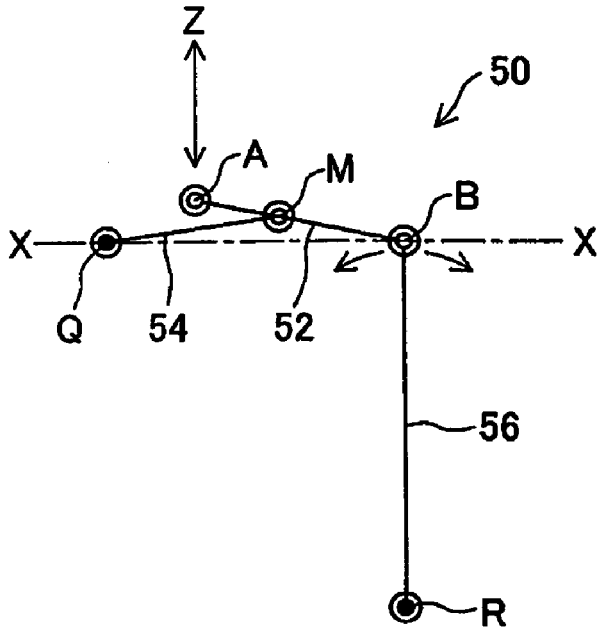
Figure 2C:
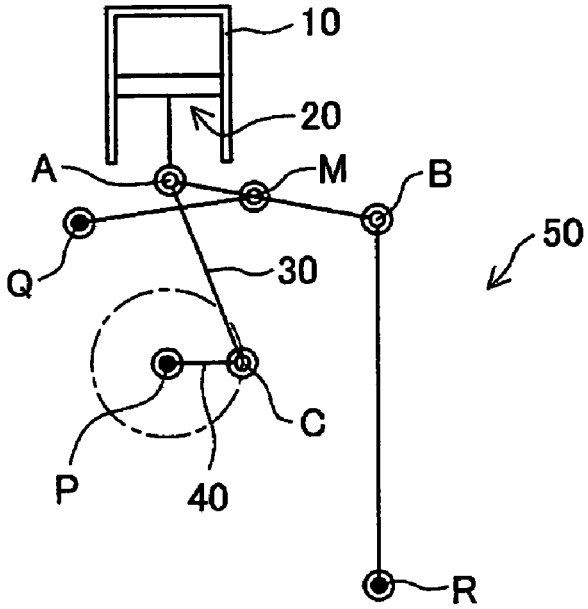

FIGS. 2A–2C are explanatory drawings showing the link construction of the piston-crank mechanism of this embodiment. FIG. 2A shows only the cylinder 10, piston 20, connecting rod 30 and crankshaft 40. FIG. 2B shows only the approximate straight-line mechanism 50. FIG. 2C combines the construction shown in FIG. 1B with the construction shown in FIGS. 2A and 2B. The approximate straight-line mechanism 50 of this embodiment is called a grasshopper approximate straight-line mechanism.

In FIGS. 2A–2C, the following linkage points are shown:

(1) Moving linkage point A: The linkage point connecting the piston 20 and the connecting rod 30. (2) Moving linkage point B: The linkage point located at the other end of the first lateral link 52 from the moving linkage point A.

(3) Moving linkage point C: The linkage point located at the opposite end of the connecting rod 30 from the moving linkage point A.

(4) Moving linkage point M: The linkage point located at a middle part of the first lateral link 52.

(5) Fulcrum point P: The center axis of the crankshaft 40 (drive axis).

(6) Fulcrum point Q: The linkage point located at the opposite end of the second lateral link 54 from the moving linkage point M.

(7) Fulcrum point R: The linkage point located at the opposite end of the vertical link 56 from the moving linkage point B.

The moving linkage point A moves in the vertical direction Z (in FIG. 2B) in tandem with the back-and-forth motion of the piston 20. In this Specification, the vertical direction Z means the direction of the axial center line of the cylinder 10 (also termed the 'axial line' below). The moving linkage points A and B are disposed at opposite ends of the first lateral link 52. The moving linkage point B has an arc-shaped locus of movement based on the turn of the vertical link 56 around the fulcrum point R. This moving linkage point B is set so as to be located at essentially the same vertical position as the vertical position X of the fulcrum point Q of the second lateral link 54.

If the vertical link 56 were assumed to have an infinite length, such that the moving linkage point B moved along the straight line formed by the vertical position X having the same vertical position as the fulcrum point Q, the moving linkage point A would move in an almost perfectly linear path in the vertical direction Z. In actuality, because the length of the vertical link 56 is finite, the moving linkage point A moves in a path that deviates slightly from a perfectly linear path (this concept will be described below).

A mechanism that provides almost perfectly linear motion can be realized by using in place of the vertical link 56 a guide member that guides the moving linkage point B in a straight line, but this results in considerable friction between the guide member and the moving linkage point B. Therefore, from the standpoint of reducing friction, the approximate straight-line mechanism 50 of this embodiment is preferable to the mechanism that provides perfectly linear motion.

The position of the moving linkage point M disposed at the middle part of the first lateral link 52 is set so as to satisfy the following equation:

$$AM \times QM = BM^2$$

Here, AM is the distance between the linkage points A and M, QM is the distance between the linkage points Q and M, and BM is the distance between the linkage points B and M.

Figure 3A:
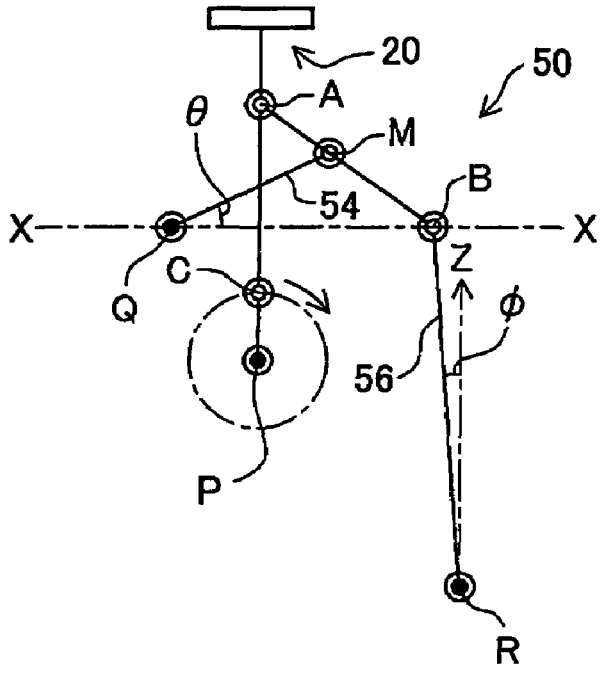
FIGS. 3A–3D illustrate the changes in configuration of the piston-crank mechanism that occur during piston motion.
Figure 3B:
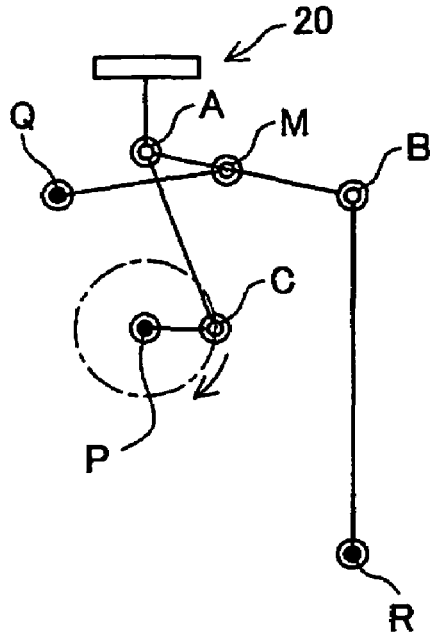
Figure 3C:
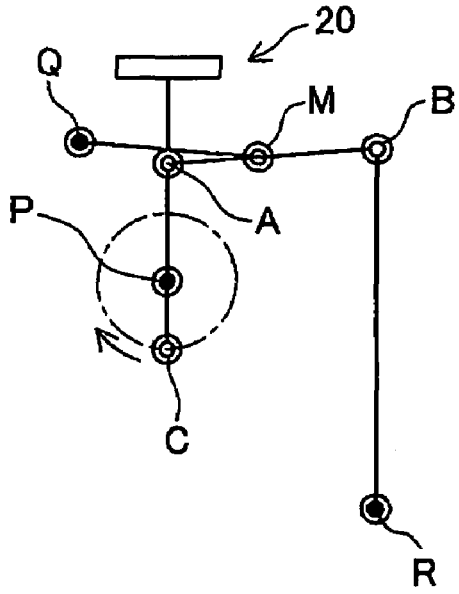
Figure 3D:
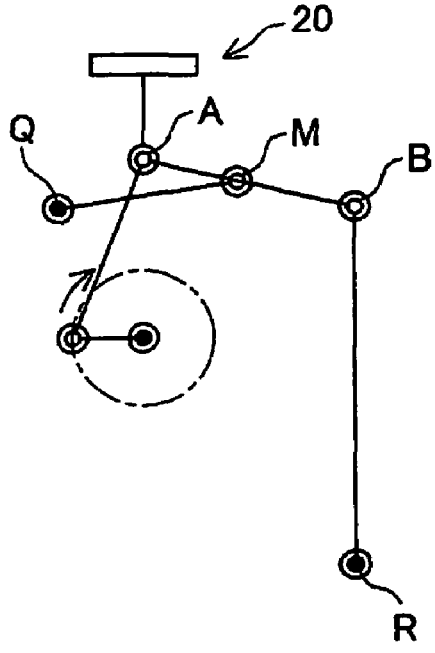

FIGS. 3A–3D show changes in the configuration of the piston-crank mechanism that occur as the piston 20 moves. Of the three moving linkage points A, B, M of the approximate straight-line mechanism 50, while the moving linkage points A and M move a substantial amount in tandem with the movement of the piston 20, the moving linkage point B at the top end of the vertical link 56 moves only a slight amount. In FIG. 3A, two angles θ and ϕ that can be used as indices to indicate the degree of change in the configuration of the approximate straight-line mechanism 50 are shown. The first angle θ is the angle ∠MQX formed by the second lateral link 54 and measured from the lateral directional line X. The second angle ϕ is the angle ∠BRZ formed by the angle of slant of the vertical link 56 as measured from the vertical directional line Z. The range of values for these angles θ and ϕ depends on the setting for the range of movement of the moving linkage point A (i.e., the stroke of the piston 20) and the lengths of the various links in the approximate straight-line mechanism 50.

Figures 4A, 4B:
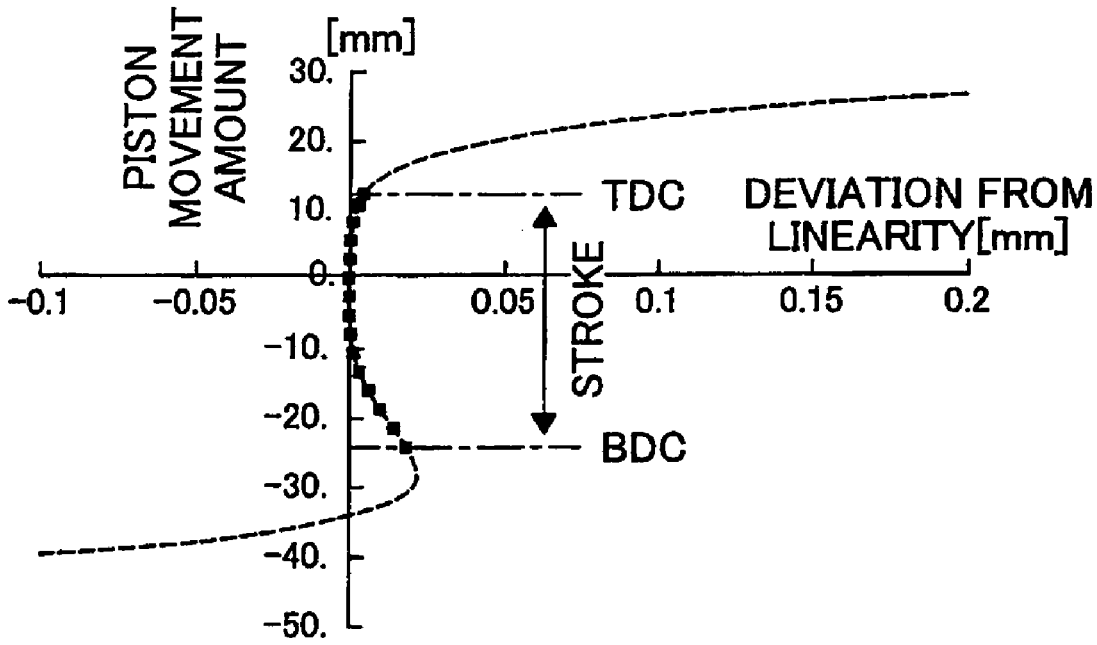
FIGS. 4A and 4B show a specific example of the dimensions of the piston-crank mechanism of the embodiment and the locus of movement of the moving linkage point A.

FIGS. 4A and 4B are explanatory drawings showing an example of the specific dimensions of the piston-crank mechanism of this embodiment and the locus of movement of the moving linkage point A. It can be seen that the dimensions shown in FIG. 4A satisfy the above relationship $AM \times QM = BM^2$. As shown in FIG. 4B, the locus of movement of the moving linkage point A includes an approximately linear section, and this approximately linear section is used as the stroke range of the piston 20. In this case, it is preferred that the stroke range of the piston 20 be set such that the amount of deviation from a straight line at TDC (top dead center) is smaller than the amount of deviation from a straight line at BDC (bottom dead center). The 'straight line' referred to here is the axial center line of the cylinder 10. In the example of FIG. 4B, the amount of deviation at TDC is approximately 5 μm, while the amount of deviation at BDC is approximately 20 μm. These values were measured at room temperature.

The amount of straight-line deviation of the moving linkage point A at TDC is set to be smaller than the amount of straight-line deviation at BDC because the combustion force of the fuel is exerted on the piston 20 in the vicinity of TDC. In other words, if the deviation amount is smaller at TDC, because the thrust (lateral force) exerted on the piston 20 by combustion force is small, the amount of friction between the piston 20 and the cylinder 10 can be reduced. At the same time, because there is no combustion force at BDC, even a substantial deviation would have a relatively insignificant impact on the amount of friction. The approximately linear portion of the locus of movement of the moving linkage point A can be increased by increasing the lengths of the links 52, 54 and 56, but this would increase the overall size of the approximate straight-line mechanism 50. In other words, the amount of straight-line deviation at TDC or BDC has a trade-off relationship with the size of the approximate straight-line mechanism 50. Taking this into account, it is preferred that the approximate straight-line mechanism 50 be constructed such that the amount of straight-line deviation of the moving linkage point A at TDC for the piston 20 does not exceed approximately 10 μm when measured at room temperature. Similarly, it is preferred that the amount of straight-line deviation at BDC not exceed approximately 20 μm.

Where the stroke range of the piston 20 is set as shown in FIG. 4B, the angle θ of the lateral link 54 exhibits a range of values from 8.8° to −17.9° (see FIG. 4A). The maximum value of 8.8° for the angle θ corresponds to the situation where the piston 20 is at TDC (see FIG. 3A), and the minimum value of −17.9° corresponds to the situation where the piston 20 is at BDC (see FIG. 3C). The angle ϕ of the vertical link 56 exhibits a range of values from 0° to 2.2°. The minimum value of 0° for the angle ϕ corresponds to the situation in which the linkage points Q, A, M and B are aligned in more or less a straight line, while the maximum value of 2.2° for the angle ϕ corresponds to the situation in which the absolute value of the angle θ is at its maximum (in this example, at BDC). The range of values for these angles θ and ϕ depends on the dimensions of the various links of the approximate straight-line mechanism 50 and on the stroke range setting for the piston 20.

B. Specific Configuration Examples

Figure 5:
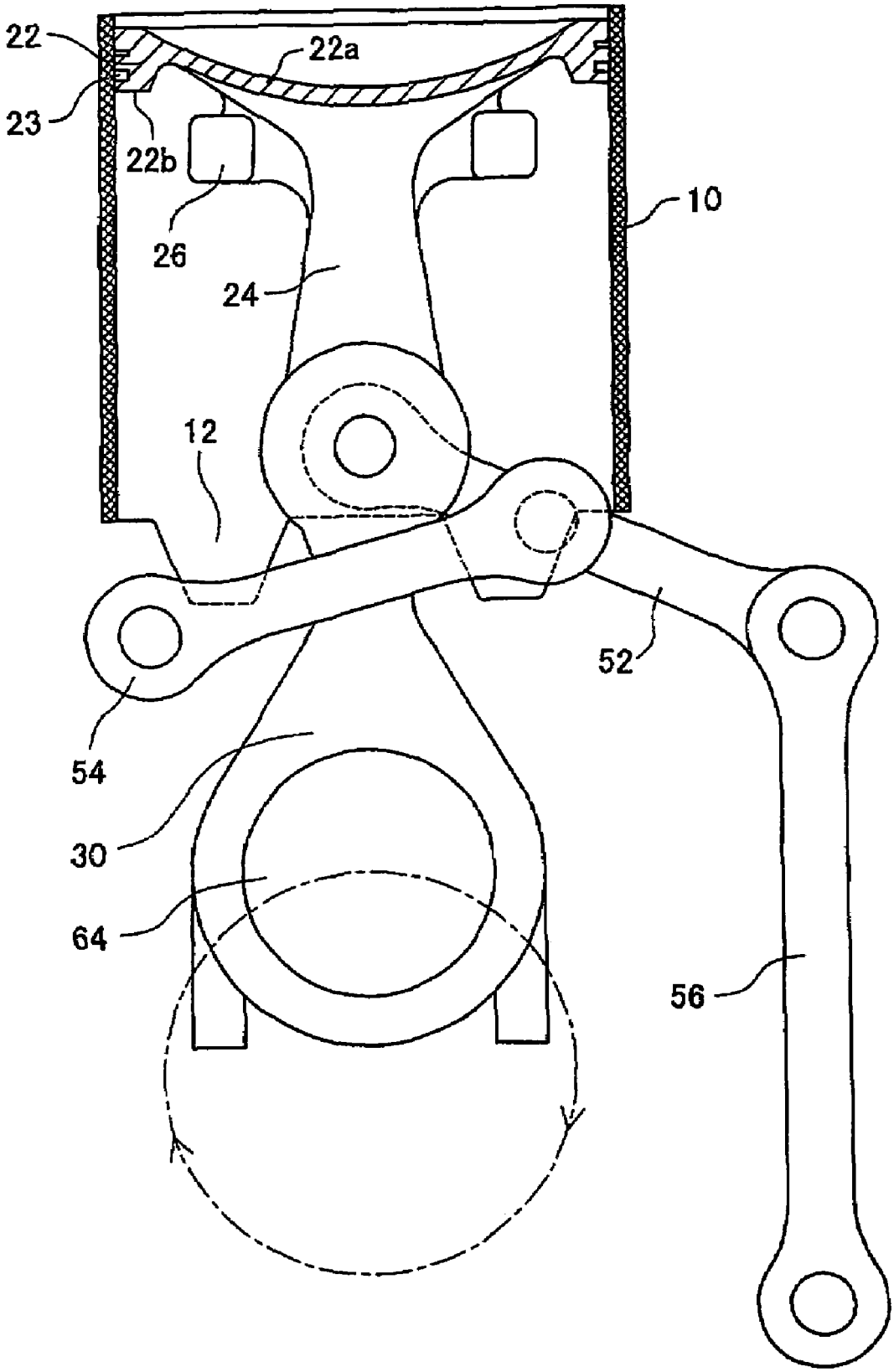
FIG. 5 is a vertical cross-sectional view of a specific example of the piston-crank mechanism of the embodiment.

FIG. 5 shows an example of a specific configuration of the piston-crank mechanism of this embodiment. The piston head 22 has a dish-like or bowl-like configuration as a whole, and has a plate-like top surface member 22*a* having a concave top surface and a ring mounting part 22*b* integrally formed at the periphery of this top surface member 22*a*. As is well known, the top surface of the piston 20 may have any of various configurations other than a simple concave configuration. The ring mounting part 22*b* has an annular configuration, and a groove 25 is formed on the outer circumferential surface thereof to receive a piston ring (not shown). A skirt of the type used in the conventional art is not disposed on this ring mounting part 22*b*. The reason for this is that because there is virtually no thrust exerted in the area of TDC, there is no need for a skirt to receive thrust.

This ring mounting part 22*b* is formed such that the transverse cross-sectional configuration thereof is almost perfectly round at room temperature. For purposes of this Specification, when it is the that a thing 'is formed to be almost perfectly round', it means that the design values for that thing, including manufacturing errors, include values for a perfectly circular configuration. The transverse cross-sectional configuration of the ring mounting part 22*b* can be made almost perfectly round because the thrust exerted on the piston 20 is small, as described above. Furthermore, because the linkage point connecting the piston 20 and the connecting rod 30 is disposed at a position (the bottom end of the piston support rod 24) that is fairly distant from the top of the piston 20, the top area of the piston 20 has a simpler construction than in the piston of the conventional art. Because the piston of the prior art has a rather complex configuration, and taking into account the complex deformation due to expansion that occurs at high temperatures, such piston is commonly formed to have an elliptical transverse cross-sectional configuration. On the other hand, because the top area of the piston 20 of this embodiment has a simpler configuration than the piston of the prior art, it is not necessary to consider the complex deformation that accompanies an increase in temperature, and the transverse cross-sectional configuration of the ring mounting part 22*b* can be made almost perfectly round even at room temperature. If the transverse cross-sectional configuration of the ring mounting part is made almost perfectly round, the sealing characteristic improves, and therefore the tension of the piston ring can be reduced in comparison with the conventional art. As a result, the friction attributable to the piston ring can be reduced as well. Making the transverse cross-sectional configuration of the ring mounting part 22*b* almost perfectly round also offers the advantage of making manufacturing of the piston 20 easier.

Support members 26 extend outward from the piston support rod 24 in the vicinity of the top end thereof. In this embodiment, the four support members 26 disposed at 90° intervals in a radial fashion extend to the inner wall surface of the cylinder 10. These support members 26 guide the piston 20 such that it moves smoothly along the inner wall surface of the cylinder while maintaining it in an upright position. The support members 26 may be omitted if the approximate straight-line mechanism 50 regulates the locus of movement of the linkage point for the piston 20 and the connecting rod 30 (i.e., the moving linkage point A) to ensure that it travels in a sufficiently straight line. However, the use of the support members 26 enables the piston 20 to move more smoothly within the cylinder 20.

It is preferred that the length of the piston support rod 24 be set such that the distance from the top of the piston 20 to the linkage point with the connecting rod 30 equals or exceeds one-half of the stroke of the piston 20 but is less than the full amount of such stroke. This is because if the piston support rod 24 is too short, the approximate straight-line mechanism 50 may collide with the cylinder 50 at TDC, while if the piston support rod 24 is too long, the weight of the piston 20 will increase, thereby increasing energy loss.

Support tabs 12 are disposed at the bottom of the cylinder 10. These support tabs 12 constitute a part of the cylinder inner wall surface positioned such that they face the support members 26 when the piston has reached BDC. The parts of the cylinder inner wall surface other than the support tab 12 are cut away since they are not necessary. Under the construction of this embodiment, because the parts of the cylinder inner wall surface that are not required can be excised, the grasshopper mechanism links 52 and 54 can be placed at the position of the excised parts, enabling the mechanism to be made smaller and lighter. While the entirety of these parts of the inner wall surface of the cylinder 10 need not be removed in this fashion, it is preferred from the standpoint of weight reduction that at least a part of the bottom of the inner wall surface of the cylinder 10 that does not face the support members 26 be eliminated.

Figure 6:
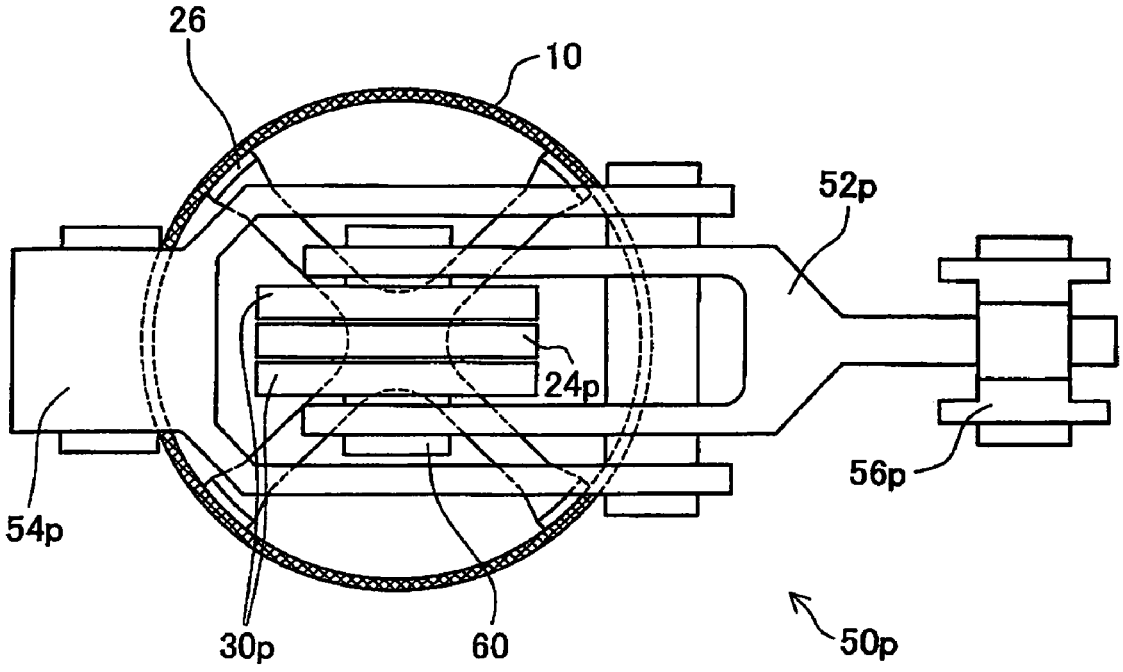
FIG. 6 is a drawing showing a piston-crank mechanism using the approximate straight-line mechanism of a comparative example.

FIG. 6 is a transverse cross-sectional view of the main components of a piston-crank mechanism having an approximate straight-line mechanism 50*p* constituting a comparative example. While the approximate straight-line mechanism 50*p* of this comparative example employs a bifurcated or double-side-support construction in its main connecting portions, the various embodiments of the approximate straight-line mechanism described below differ from the comparative example in that the main connecting portions use a single-side-support construction.

In this comparative example, the piston support rod 24*p*, connecting rod 30*p* and lateral links 52*p* and 54*p* are constructed such that they do not obstruct each other even when the piston is moving up and down. Specifically, the piston support rod 24*p* is disposed in the axial center of the cylinder 10, and both sides of the piston support rod 24*p* are grasped by two plate-shaped members of the connecting rod 30*p*. Two plate-shaped members belonging to the first lateral link 52*p* are disposed on the outer sides of the connecting rod 30*p*. These three members 24*p*, 30*p* and 52*p* are connected by a piston pin 60. In addition, two plate-shaped members belonging to the second lateral link 54*p* are disposed on the outer sides of the first lateral link 52*p*. As a result, in the comparative example, the connecting rod 30 and the two lateral links 52*p* and 54*p* have a bifurcated construction in which their ends are divided into two plate-like members, and are each positioned such that they are disposed on either side of the center piston support rod 24*p*.

Figure 7:
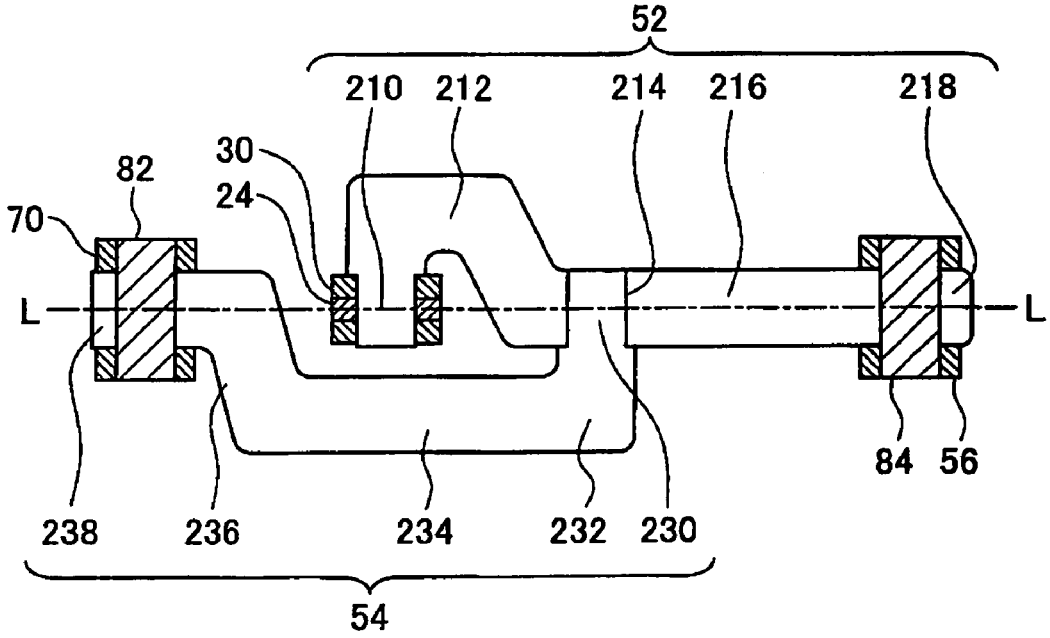
FIG. 7 is a drawing showing the construction of the connecting portions of the approximate straight-line mechanism of the first embodiment of the present invention.

FIG. 7 is a transverse cross-sectional view of the construction of the connecting portions of the approximate straight-line mechanism pertaining to the first embodiment of the present invention, and corresponds to FIG. 6. However, for the sake of convenience, the piston support members 26 and the cylinder 10 are omitted from the drawing in FIG. 7, and the hatch lines on the first lateral link 52 and second lateral link 54 are omitted.

The first lateral link 52 has a first connecting end 210 and a second connecting end 218 disposed at either end thereof The first connecting end 210 is connected to the connecting portion connecting the piston support rod 24 and the connecting rod 30. The second connecting end 218 is connected to one end of the vertical link 56. In this embodiment, the first connecting end 210 constitutes a stepped turning shaft (also termed an 'engaging protrusion' below), while the corresponding ends of the piston support rod 24 and connecting rod 30 each constitutes a bearing (also termed an 'engaging recession' below) in which the first connecting end 210 is inserted. The second connecting end 218 and the end of the vertical link 56 each constitutes a bearing, and are connected to each other by a connecting pin 84. A curved section 212 (termed a 'bent section' below) and a straight section 216 are disposed between the first and second connecting ends 210 and 218. A connecting hole (bearing) 214 is disposed in the straight section 216. The connecting end 230 of the second lateral link 54 is inserted in this connecting hole 214. The straight section 216 runs along the straight line that connects the first and second connecting ends 210 and 218 as seen from the direction of piston motion (i.e., from the direction perpendicular to the surface of the paper containing the drawing). In addition, the first connecting end 210 is inserted, in a downward direction in the drawing, into the connecting portion connecting the piston support rod 24 and the connecting rod 30. The bent section 212 is formed such that it connects the first connecting end 210 and the straight section 216.

The second lateral link 54 has a first connecting end 230 and a second connecting end 238 at either end thereof. The first connecting end 230 has a stepped turning shaft construction, and is inserted in the connecting hole 214 of the first lateral link 52. The second connecting end 238 constitutes a bearing, and is connected by a connecting pin 82 that passes therethrough as well as through a turning station part 70 disposed at a prescribed position in the piston engine. A first bent section 232, a straight section 234 and a second bent section 236 are disposed between the first and second connecting ends 230 and 238. Unlike the straight section 216 of the first lateral link 52, the straight section 234 is disposed at a position that is offset from the straight line connecting the first and second connecting ends 230 and 238 as seen from the direction of piston motion. Furthermore, the first connecting end 230 is inserted, in an upward direction in the drawing, into the connecting hole 214 of the first lateral link 52. Accordingly, the first bent section 232 is bent at a 90° angle in order to connect the first connecting end 230 and the straight section 234. In addition, because the straight section 234 is offset from the straight line connecting the connecting ends 230 and 238, the second bent section 236 is formed to connect the straight section 234 and the second connecting end 238.

In the first embodiment, the tips of the piston support rod 24 and the connecting rod 30 constitute bearings. The tip of the connecting rod 30 has a bifurcated construction such that it sandwiches either side of the tip of the piston support rod 24. However, the tips of the piston support rod 24 and the connecting rod 30 may have the reverse construction and positional relationship from those seen in FIG. 7. In other words, it is acceptable if the tip of the piston support rod 24 has a bifurcated construction such that it sandwiches either side of the tip of the connecting rod 30. With either construction, because the piston support rod 24 and connecting rod 30 have a symmetrical configuration as seen from the direction of piston movement, the occurrence of lateral force, which would be caused by an asymmetrical configuration, can be prevented.

The construction of the first embodiment shown in FIG. 7 has the various features and advantages described below. The first feature is that the first connecting end 210 of the first lateral link 30 has a single-side-support construction such that its end engages with the connecting portion connecting the piston support rod 24 and the connecting rod 30 from a prescribed single side. Similarly, the connecting end 230 of the second lateral link 54 also has a single-side-support construction such that its end engages with the connecting hole 214 of the first lateral link 52 from a prescribed single side. The use of such a single-side-support construction offers the benefit of making it easy to assemble the approximate straight-line mechanism. In particular, in the first embodiment, the first connecting ends 210, 230 of the first and second lateral links 52, 54 have a non-forked construction in which the tip is not forked. The use of this non-forked construction further increases the ease of assembly of the approximate straight-line mechanism. In the comparative example shown in FIG. 6, because the first and second lateral links 52, 54 both have a bifurcated construction, assembly is fairly difficult. In the first embodiment, by contrast, because the first connecting ends 210, 230 of the first and second lateral links 52, 54 have a non-forked construction, assembly is easier than it is for the comparative example. Furthermore, a non-forked construction offers the advantage of superior strength in comparison with a forked construction such as a bifurcated construction.

The second feature is that the first connecting ends 210, 230 of the first and second lateral links 52, 54 are constructed as turning shafts. This construction makes the use of a separate connecting pin in these connecting portions unnecessary. As a result, the number of component parts in the approximate straight-line mechanism can be reduced relative to the comparative example, thereby simplifying the construction.

The third feature is that the connecting portion connecting the piston support rod 24 and the connecting rod 30 is disposed between the first and second lateral links 52, 54 as seen from the direction of piston movement. More specifically, the connecting portion connecting the piston support rod 24 and the connecting rod 30 is disposed between the bent section 212 of the first lateral link 52 and the straight section 234 of the second lateral link 54. Because this construction ensures improved mechanical balance, the various members can be made lighter and friction can be reduced. Moreover, in order to achieve this third feature, the first connecting ends 210, 230 of the first and second lateral links 52, 54 engage with their respective connecting portions from the reverse, parallel directions. In other words, the first connecting end 210 of the first lateral link 52 is inserted downward in the drawing into the connecting portion connecting the piston support rod 24 and the connecting rod 30, while the first connecting end 230 of the second lateral link 54 is inserted upward in the drawing into the connecting hole 214 of the first lateral link 52. It is not essential that the directions of engagement of the connecting ends 210, 230 be the reverse, parallel directions, but if this is the case, a construction in which 'the connecting portion connecting the piston support rod 24 and the connecting rod 30 is disposed between the first and second lateral links 52, 54 as viewed from the direction of piston motion' can be easily achieved.

The fourth feature is that the four connecting portions (connecting positions) of the approximate straight-line mechanism are disposed in a straight line as seen from the direction of piston motion. Specifically, the four connecting portions including (i) the connecting portion connecting the first lateral link 52 and the vertical link 56, (ii) the connecting portion connecting the first and second lateral links 52, 54, (iii) the connecting portion connecting the piston support rod 24, the connecting rod 30 and the first lateral link 52, and (iv) the connecting portion connecting the second lateral link 54 and the turning station member 70 of the piston engine, are aligned in a straight line. Because such a construction ensures improved mechanical balance, the various members can be reduced in weight and friction can be reduced. In FIG. 7 and in the drawings of the other embodiments described below, a straight line coterminous with the axis of the connecting portion connecting the piston support rod 24, the connecting rod 30 and the first lateral link 52 is indicated by the straight line L—L.

Figure 8:
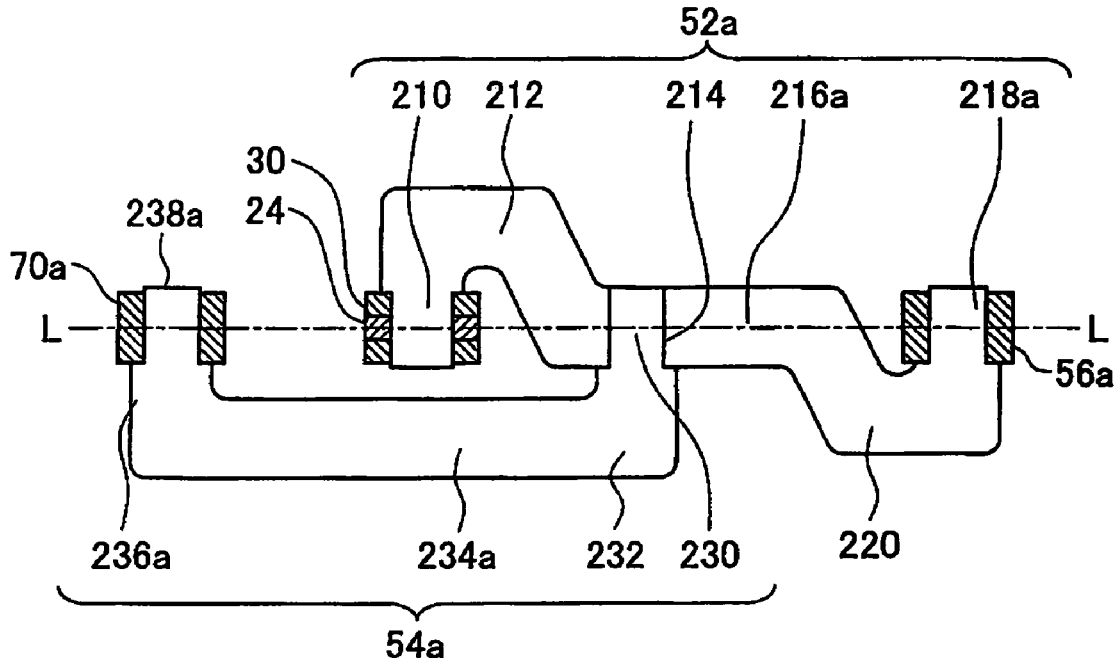
FIG. 8 is a drawing showing the construction of the connecting portions of the approximate straight-line mechanism of a second embodiment of the present invention.

FIG. 8 is a transverse cross-sectional view of the main components of the construction of the connecting portions of an approximate straight-line mechanism of a second embodiment of the present invention. This construction differs from that of the first embodiment in regard to the construction of (i) the connecting portion connecting the first lateral link 52*a* and the vertical link 56*a*, and (ii) the connecting portion connecting the second lateral link 54*a* and the turning station part 70*a* of the piston engine, but is otherwise the same as the construction of the first embodiment.

The second connecting end 218*a* of the first lateral link 52*a* is formed as a turning shaft, while the end of the vertical link 56*a* constitutes a bearing. Because the connecting portion does not require a separate connecting pin, fewer parts are used than are present in the first embodiment. In addition, the connecting end 218*a* is inserted upward in the drawing into the vertical link 56*a*, and has a single-side-support construction. Accordingly, a bent section is present to connect the connecting end 218*a* and the straight section 216*a*. In this respect, the first lateral link 52*a* has a more complex configuration than the first lateral link 52 of the first embodiment.

The second connecting end 238*a* of the second lateral link 54*a* also constitutes a turning shaft. Because the connecting portion connecting this second connecting end 238*a* and the turning station part 70 of the piston engine does not require the use of a separate connecting pin, fewer parts are needed than in the first embodiment. Moreover, this second connecting end 238*a* is constructed as a one-side-support that is inserted in the bearing from the same direction as the first connecting end 230. Consequently, the bent section 236*a* that connects the second connecting end 238*a* and the straight section 216*a* has a simple 90° bend. This second embodiment achieves almost the same effect as the first embodiment described above.

Figure 9:
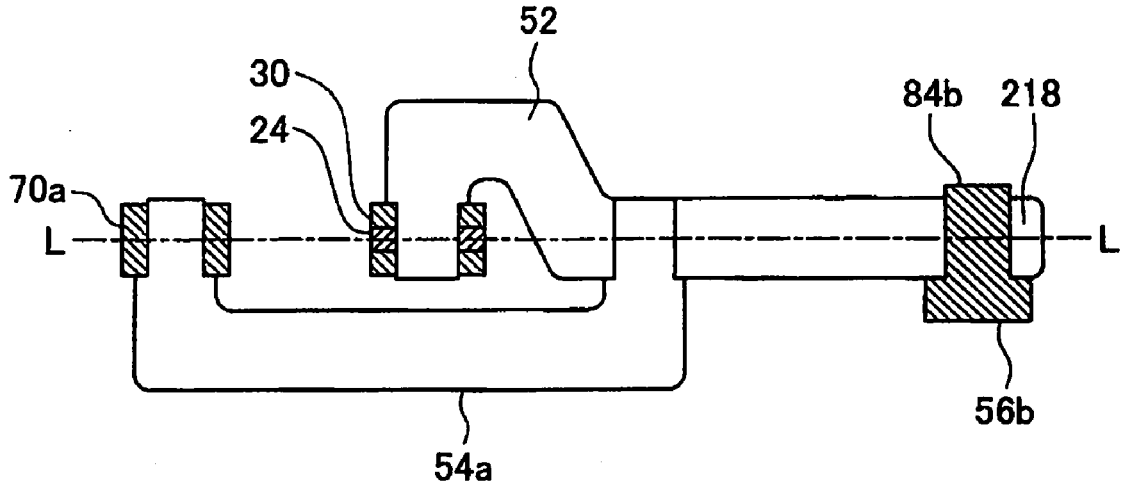
FIG. 9 is a drawing showing the construction of the connecting portions of the approximate straight-line mechanism of a third embodiment of the present invention.

FIG. 9 is a transverse cross-sectional view of the main components of the construction of the connecting portions of an approximate straight-line mechanism of a third embodiment of the present invention. The first lateral link 52 of this third embodiment is identical to that of the first embodiment shown in FIG. 7, while the second lateral link 54*a* is identical to that of the second embodiment shown in FIG. 8. However, the configuration of the connecting end of the vertical link 56*b* is different from the corresponding configuration in the first or second embodiments. In the third embodiment, a turning shaft 84*b* protrudes from the connecting end of the vertical link 56*b* and this turning shaft 84*b* is inserted in the connecting end (bearing) 218 of the first lateral link 52. Therefore, a separate connecting pin is not required for the connecting portion connecting the first lateral link 52 and the vertical link 56*b*. The third embodiment achieves almost the same effect as the first and second embodiments.

Figure 10:
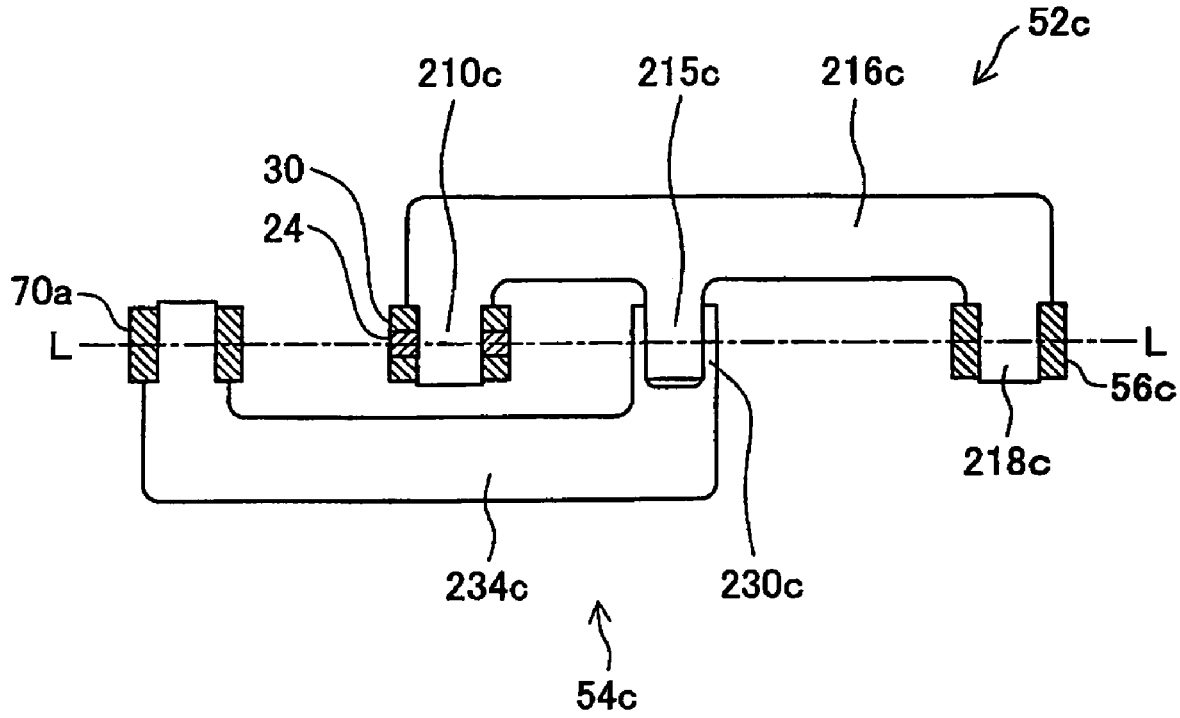
FIG. 10 is a drawing showing the construction of the connecting portions of the approximate straight-line mechanism of a fourth embodiment of the present invention.

FIG. 10 is a transverse cross-sectional view of the main components of the construction of the connecting portions of an approximate straight-line mechanism of a fourth embodiment of the present invention. In this fourth embodiment, the first and second lateral links 52*c*, 54*c* have a different configuration from the corresponding components in any of the previous embodiments. The first lateral link 52*c* and the straight section 216*c* are disposed at positions that are offset from the line connecting the four connecting portions. In addition, a connecting shaft 215*c* that connects to the second lateral link 54*c* protrudes from a position roughly midway along the straight section 216*c*. This connecting shaft 215*c* and the first and second connecting ends 210*c* and 218*c* are all turning shafts that protrude downward in the drawing. The second connecting end 218*c* is inserted in the connecting end (bearing) of the vertical link 56*c*. The second lateral link 54*c* differs from the second lateral link of the second embodiment shown in FIG. 8 in that the first connecting end 230*c* constitutes a bearing. This fourth embodiment achieves almost the same effect as the first through third embodiments. In addition, because the straight sections 216*c*, 234*c* of the first and second lateral links 52*c*, 54*c* are offset from each other on opposite sides of the connecting portion connecting piston support rod 24 and the connecting rod 30, a better overall balance is attained in comparison with the first through third embodiments.

Figure 11:
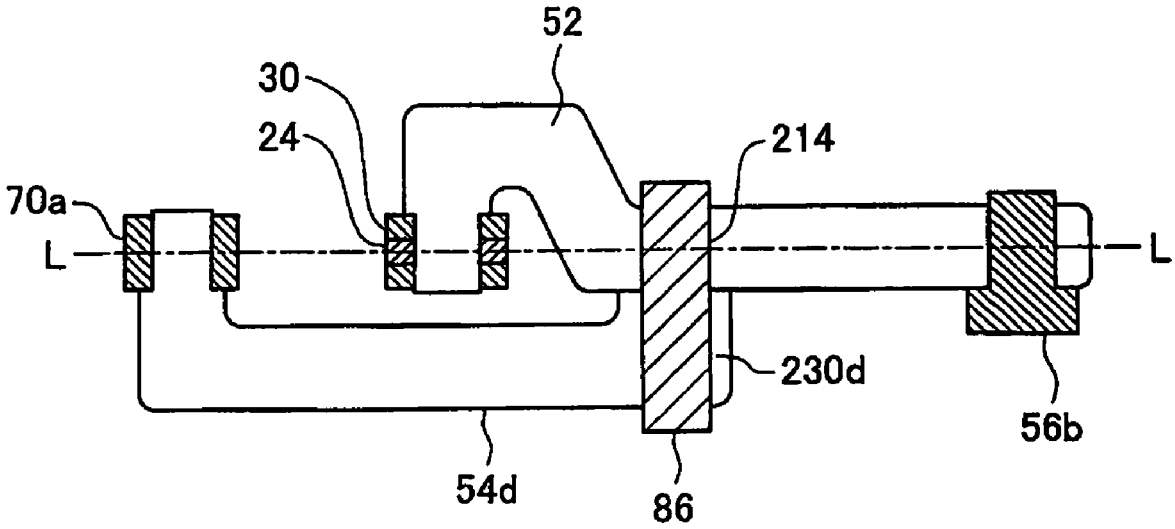
FIG. 11 is a drawing showing the construction of the connecting portions of the approximate straight-line mechanism of a fifth embodiment of the present invention.

FIG. 11 is a transverse cross-sectional view of the main components of the construction of the connecting portions of an approximate straight-line mechanism pertaining to a fifth embodiment of the present invention. The first lateral link 52 and vertical link 56*b* of this fifth embodiment are identical to the corresponding components in the third embodiment shown in FIG. 9, while the second lateral link 54*d* is different from such corresponding component. The first connecting end 230*d* of the second lateral link 54*d* constitutes a bearing, and is connected by a connecting pin 86 that passes therethrough as well as through the connecting hole 214. This fifth embodiment achieves almost the same effect as the first through fourth embodiments.

Figure 12:
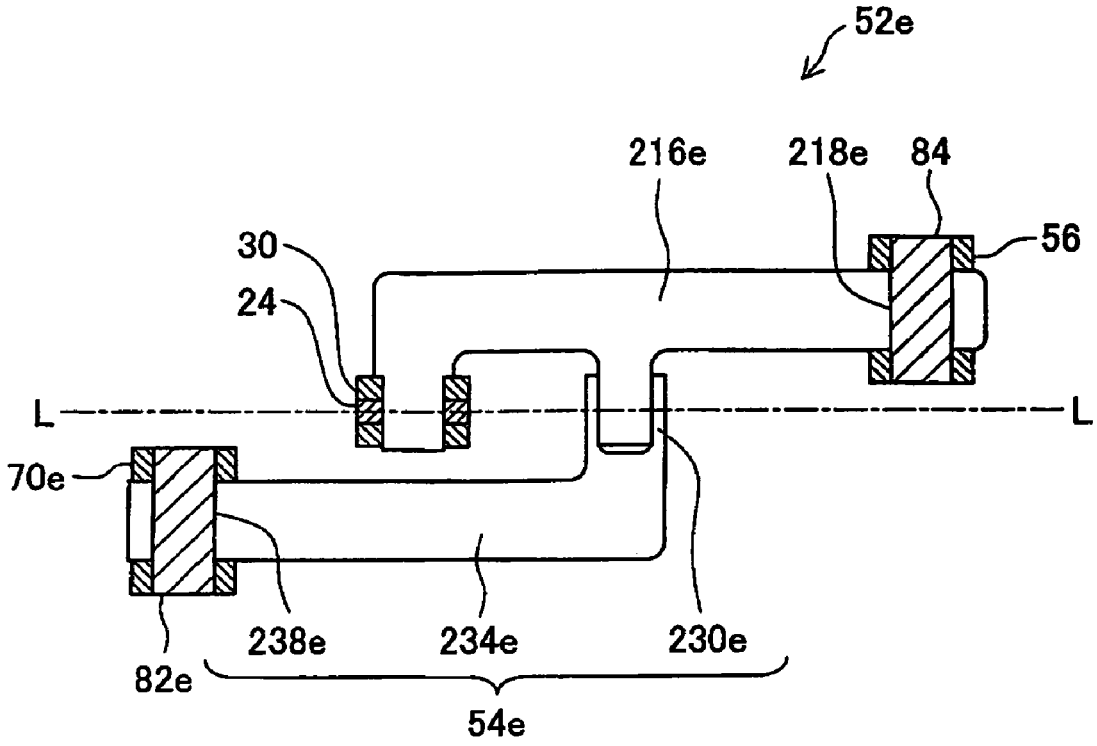
FIG. 12 is a drawing showing the construction of the connecting portions of the approximate straight-line mechanism of a sixth embodiment of the present invention.

FIG. 12 is a transverse cross-sectional view of the main components of the connecting portions of an approximate straight-line mechanism of a sixth embodiment of the present invention. This sixth embodiment differs from the fourth embodiment shown in FIG. 10 in regard to the construction of the second connecting ends 218*e*, 238*e* of the first and second lateral links 52*e*, 54*e*. Specifically, the second connecting end 218*e* of the first lateral link 52*e* constitutes a bearing disposed at the tip of the straight section 216*e*. The construction pertaining to the connecting portion connecting the second connecting end 218*e* and the vertical link 56 is identical to that of the first embodiment shown in FIG. 7, such that the connecting end 218*e* and the vertical link 56 are connected by a connecting pin 84. The second connecting end 238*e* of the second lateral link 54*e* also constitutes a bearing disposed at the tip of the straight section 234*e*. The construction of the connecting portion connecting the second connecting end 238*e* and the turning station part 70*e* of the piston engine is also identical to that of the first embodiment shown in FIG. 7, such that the connecting end 238*e* and the turning station part 70*e* are connected by a connecting pin 82*e*. The sixth embodiment differs substantially from the other embodiments in that the four connecting portions are not disposed in a straight line. Because such an arrangement may make achievement of overall mechanical balance more difficult, the linear arrangement of the first through fifth embodiments described above may be preferable. However, the sixth embodiment is preferred, as in the case of the fourth embodiment, from the standpoint that the two lateral links 52*e*, 54*e* are offset from each other on opposite sides of the connecting portion connecting the piston support rod 24 and the connecting rod 30.

Figure 13:
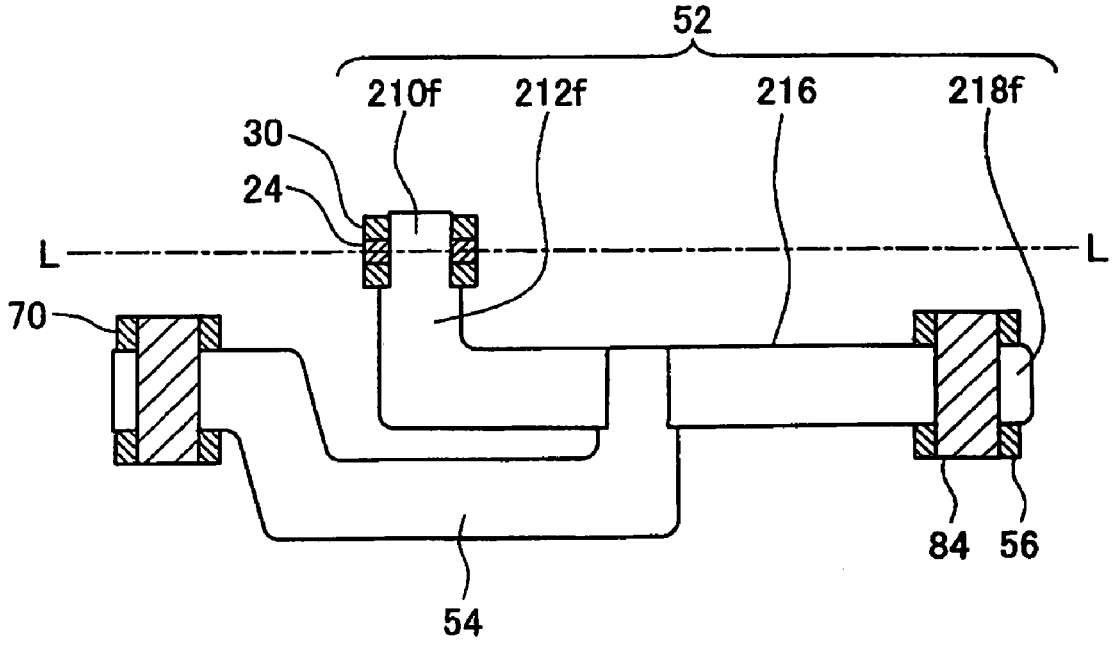
FIG. 13 is a drawing showing the construction of the connecting portions of the approximate straight-line mechanism of a seventh embodiment of the present invention.

FIG. 13 is a transverse cross-sectional view of the main components of the construction of the connecting portions of an approximate straight-line mechanism of a seventh embodiment of the present invention. The second lateral link 54 and vertical link 56*c* of the seventh embodiment are identical to those of the first embodiment shown in FIG. 7, while the first lateral link 52*f* differs from that of the first embodiment. The first connecting end 210*f* of the first lateral link 54*f* constitutes a stepped turning shaft, and is inserted upward into the connecting portion connecting the piston support rod 24 and the connecting rod 30. Consequently, the bent section 212*f* that connects the straight section 216*f* and the first connecting end 210*f* is bent at a 90° angle. In this seventh embodiment, the position of the connecting portion connecting the piston support rod 24, the connecting rod 30 and the first lateral link 52*f* is different from that of the corresponding component in any of the first through sixth embodiments in that it is offset from the straight line that connects the other three connecting portions. Specifically, in the seventh embodiment, the two lateral links are offset in the same direction as seen from the connecting portion connecting the piston support rod 24 and the connecting rod 30. Therefore, from the standpoint of the mechanical balance of the two lateral links connected to the piston support rod 24 and the connecting rod 30, the first through sixth embodiments may be preferred to the seventh embodiment.

Figure 14A:
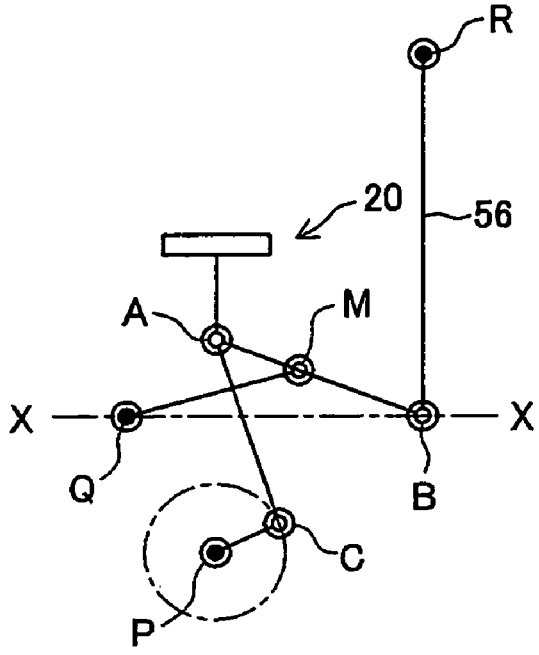
FIGS. 14A–14C illustrate other variations of the piston-crank mechanism.
Figure 14B:
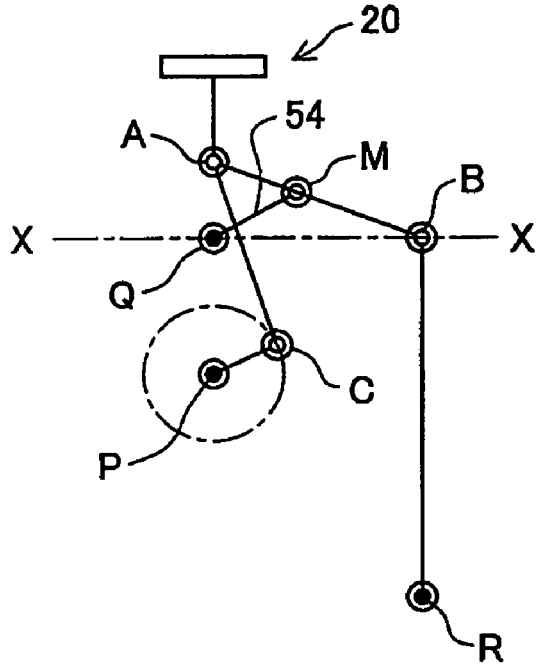
Figure 14C:
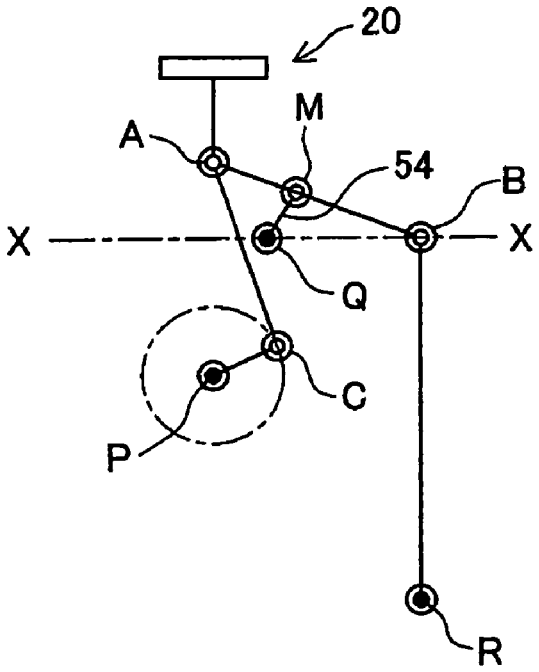

FIGS. 14A–14C are explanatory drawings showing variations of the piston-crank mechanism. In the mechanism shown in FIG. 14A, the lateral link 56 of the mechanism shown in FIGS. 2A–2C is placed above the linkage point B, while the other constituent elements are identical to those of the mechanism shown in FIGS. 2A–2C. The same effect achieved by the mechanism of FIGS. 2A–2C can be achieved by the mechanism of FIGS. 14A as well.

The mechanism shown in FIG. 14B is the same as the mechanism shown in FIG. 2A–2C except that the fulcrum point Q thereof is moved toward the moving linkage point B such that it is located on the straight line that connects the moving linkage point A (i.e., the piston pin) and the fulcrum point P (i.e., the crankshaft). The other constituent elements are identical to those of the mechanism shown in FIGS. 2A–2C. In the mechanism shown in FIG. 14C, the fulcrum point Q is further moved to the right. In the mechanisms shown in FIGS. 14B and 14C, the length of the second lateral link 54 is shorter than that of the mechanism shown in FIGS. 2A–2C, offering the benefit of increased compactness. The mechanism shown in FIG. 14B has the benefit of better linearity than that achieved by the mechanisms shown in FIGS. 14A and 14C. In the case of the mechanisms shown in FIGS. 14B and 14C, a construction is adopted, as in the case of FIG. 12 described above, in which the connecting portion 70*e* connecting the second lateral link 54*e* and the piston mechanism is offset relative to the connecting portion connecting the piston support rod 24 and the connecting rod 30.

Figure 15:
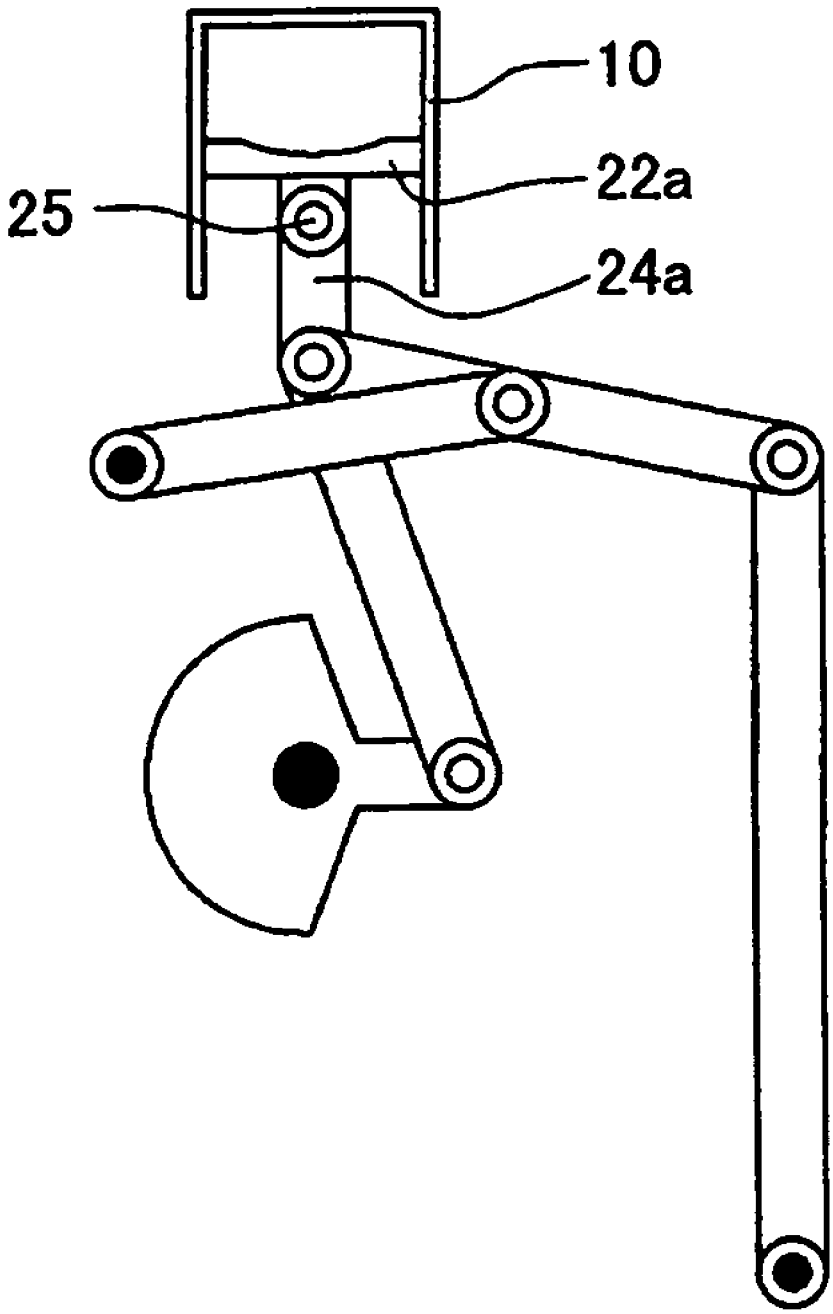
FIG. 15 is an explanatory drawing showing yet another variation of the piston-crank mechanism.

FIG. 15 is an explanatory drawing showing another embodiment of the piston-crank mechanism. While the piston head 22 and the piston support rod 24 were integrally formed in the mechanism shown in FIG. 1B, in the mechanism shown in FIG. 15, the piston head 22*a* and the piston support rod 24*a* are formed separately. The bottom of the piston head 22*a* and the top of the piston support rod 24*a* are turnably connected to each other by a pin 23. The construction of FIG. 15 offers the advantage that, even where the locus of movement of the lower end of the piston support rod 24*a* deviates slightly from a straight line, such deviation does not operate as force that will cause the alignment of the piston head 22*a* to become slanted (in other words, the deviation at the lower end of the piston support rod 24*a* has little impact on the piston head 22*a*). In addition, in comparison with the situation in which the piston head and piston support are integrally formed, the construction of FIG. 15 also offers the benefit that the piston head may be fitted more easily to the approximate straight-line mechanism and the connecting rod. On the other hand, the mechanism shown in FIG. 1B provides the benefit that, where the alignment of the piston head 22 starts becoming slanted relative to the cylinder 10 for some reason, such slanting can be corrected when the piston support rod 24 moves along an approximately straight-line path.

As described above, in the embodiments and variations thereof described above, because the bottom end of the piston 20 traces an approximately straight-line locus of movement along the center axis of the cylinder 20 with the aid of an approximate straight-line mechanism 50 in the piston-crank mechanism, friction between the piston 20 and the cylinder 10 can be substantially reduced.

C. Other Variations

C1. Variation 1

With regard to the present invention, not only a grasshopper approximate straight-line mechanism but also any other approximate straight-line mechanism may be adopted. For example, Watt's approximate straight-line mechanism can be used. It is preferred in this case as well that the approximate straight-line mechanism has a plurality of nearly-straight links. In addition, as in the embodiments shown in FIGS. 7-13, it is preferred that the engaging ends of the plurality of nearly-straight links (e.g., the portions equivalent to those at the connecting end 230 in FIG. 7) and the engaging end of the nearly-straight link that engages with the connecting portion connecting the piston and the connecting rod (i.e., the portion equivalent to the connecting end 210 in FIG. 7) have a single-side-support construction in which a protrusion is inserted from a prescribed side while the components are turnably connected. It is also preferred that the approximate straight-line mechanism be constructed such that the deviation amount at TDC from the cylinder center axis is smaller than the deviation amount at BDC. In the grasshopper approximate straight-line mechanism described in connection with the above embodiments, because the point that moves along an approximately straight line (i.e., the moving linkage point A) is disposed toward one end of the mechanism, such approximate straight-line mechanism is particularly suited for regulating the motion of the piston of an internal combustion engine, and can offer good linearity while providing a compact mechanism.

C2. Variation 2

In the embodiments described above, a piston 20 having a piston head 22 and piston support rod 24 is used, but it is also possible to use a piston having a construction similar to the piston 120 of the conventional art (see FIG. 1A). However, the use of a piston 20 having a piston head 22 and piston support rod 24 is advantageous because it is easier to prevent interference between the approximate straight-line mechanism 50 and the cylinder 10, enabling the approximate straight-line mechanism 50 to be made more compact.

C3. Variation 3

In the embodiments described above, the support members 26 are connected to the piston support rod 24, but it is also acceptable if the support members 26 are connected to a different part of the piston (e.g., the bottom of the piston head 22) instead. In other words, so long as support members to prevent lateral deviation of the piston are disposed near the cylinder inner wall, their precise location on the piston is not critical. A skirt smaller than that used with the conventional piston may be used in place of the support members. For such a skirt, a member having a smaller thrust (side force) resistance capability (e.g., a side force resistance capability equal to around one-half of that provided in the prior art) than the skirt used in the piston design of the conventional art (i.e., the piston design that does not use an approximate straight-line mechanism) may be used for a piston engine of the same type having the same cylinder inner dimensions. Specifically, a skirt having an approximately half the area of the skirt used in the conventional piston design can be used, for example.

C4. Variation 4

The piston-crank mechanism of the present invention can be used in any piston engine including an internal combustion engine such as a gasoline engine or diesel engine as well as an external engine such as a Sterling engine. The present invention can also be realized as a vehicle or moving body that includes such a piston engine.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A piston engine comprising:

a cylinder;

a piston configured to move back and forth inside the cylinder;

a crankshaft configured to revolve around a drive axis;

a connecting rod configured to connect the piston to the crankshaft; and an approximate straight-line mechanism, connected to a connecting portion connecting the piston and the connecting rod, for regulating movement of the connecting portion such that the connecting portion moves approximately parallel to a central axis of the cylinder, wherein the approximate straight-line mechanism has a plurality of nearly-straight links, and engaging ends of the nearly-straight links, as well as an engaging end of the nearly-straight link that engages with the connecting portion connecting the piston and the connecting rod, constitute a turnable single-side-support construction that enables the nearly-straight links to be turnably connected while engaging from a prescribed direction.

2. A piston engine comprising:

a cylinder;

a piston configured to move back and forth inside the cylinder;

a crankshaft configured to revolve around a drive axis;

a connecting rod configured to connect the piston to the crankshaft; and an approximate straight-line mechanism, connected to a connecting portion connecting the piston and the connecting rod, for regulating movement of the connecting portion such that the connecting portion moves approximately parallel to a central axis of the cylinder, wherein the approximate straight-line mechanism is a grasshopper approximate straight-line mechanism that has first and second lateral links and a vertical link, a first end of the first lateral link has a turnable single-side-support construction such it is turnably connected to the connecting portion connecting the piston and the connecting rod while engaging from a prescribed first direction, a second end of the first lateral link is turnably linked to a first end of the vertical link, a second end of the vertical link is turnably fixed at a prescribed position on the piston engine, a first end of the second lateral link has a single-side-support construction such that it is turnably connected to an engaging portion disposed midway along the first lateral link while engaging from a prescribed second direction, and a second end of the second lateral link is turnably fixed at a prescribed position on the piston engine.

3. A piston engine according to claim 2, wherein the first end of the first lateral link and the first end of the second lateral link have a non-forked construction.

4. A piston engine according to claim 2, wherein a selected one of the first end of the second lateral link and an engaging end of the first lateral link has a turning shaft construction and the other one has a bearing construction.

5. A piston engine according to claim 2, wherein the connecting portion connecting the piston and the connecting rod is disposed between the first lateral link and the second lateral link when viewed along a direction of motion of the piston.

6. A piston engine according to claim 5, wherein the first direction in which the first end of the first lateral link engages with the connecting portion is a reverse, parallel direction from the second direction in which the first end of the second lateral link engages with the engaging portion.

7. A piston engine according to claim 2, wherein when viewed from a direction of motion of the piston, four positions including (i) a position at which the second end of the first lateral link connects to the first end of the vertical link, (ii) a position of the engaging portion of the first lateral link, (iii) a position at which the piston connects to the connecting rod, and (iv) the prescribed position at which the second end of the second lateral link is connected to the piston engine, are aligned in a straight line.

* * * * *